US009028954B2

(12) United States Patent
Schier

(10) Patent No.: US 9,028,954 B2
(45) Date of Patent: May 12, 2015

(54) CUTTING TOOL WITH MULTI-LAYER COATING

(75) Inventor: Veit Schier, Leinfelden-Echterdingen (DE)

(73) Assignee: Walter AG, Tübingen (DE)

( * ) Notice: Subject to any disclaimer, the term of this patent is extended or adjusted under 35 U.S.C. 154(b) by 160 days.

(21) Appl. No.: 13/813,569

(22) PCT Filed: Aug. 1, 2011

(86) PCT No.: PCT/EP2011/063234
§ 371 (c)(1),
(2), (4) Date: Apr. 11, 2013

(87) PCT Pub. No.: WO2012/016954
PCT Pub. Date: Feb. 9, 2012

(65) Prior Publication Data

US 2013/0216804 A1 Aug. 22, 2013

(30) Foreign Application Priority Data

Aug. 6, 2010 (DE) ..... 10 2010 039 035

(51) Int. Cl.
*C23C 28/00* (2006.01)
*C23C 28/04* (2006.01)
*C23C 30/00* (2006.01)

(52) U.S. Cl.
CPC ..... *C23C 28/044* (2013.01); *Y10T 428/265* (2015.01); *Y10T 428/24975* (2015.01); *C23C 30/005* (2013.01); *C23C 28/042* (2013.01); *C23C 28/322* (2013.01); *C23C 28/34* (2013.01); *C23C 28/345* (2013.01); *C23C 28/3455* (2013.01); *C23C 28/347* (2013.01)

(58) Field of Classification Search
USPC ..... 51/307, 309; 428/216, 336, 469, 472, 428/697, 698, 699, 701, 702, 704
See application file for complete search history.

(56) References Cited

U.S. PATENT DOCUMENTS

| | | | | |
|---|---|---|---|---|
| 5,700,551 | A | 12/1997 | Kukino et al. | |
| 5,915,162 | A * | 6/1999 | Uchino et al. | 428/698 |
| 6,245,446 | B1 | 6/2001 | Schier et al. | |
| 6,586,122 | B2 * | 7/2003 | Ishikawa et al. | 428/698 |
| 6,858,333 | B2 * | 2/2005 | Henderer | 428/699 |
| 7,144,208 | B2 * | 12/2006 | Henderer et al. | 408/144 |
| 8,409,695 | B2 * | 4/2013 | Ni et al. | 428/216 |
| 2004/0072038 | A1 | 4/2004 | Henderer | |

FOREIGN PATENT DOCUMENTS

| | | | |
|---|---|---|---|
| EP | 0 149 449 | | 7/1985 |
| EP | 0 302 984 | | 2/1989 |
| EP | 0 653 499 | | 5/1995 |
| JP | 59-025968 | A | 2/1984 |
| JP | H08-134629 | A | 5/1996 |
| JP | 2000-326108 | * | 11/2000 |
| JP | 2007-319964 | A | 12/2007 |
| JP | 2009-293131 | A | 12/2009 |
| JP | 2011-051033 | A | 3/2011 |
| WO | 96/23911 | | 8/1996 |
| WO | 2005/120786 | | 12/2005 |

OTHER PUBLICATIONS

Sakurai et al "Surface morphology and mechanical properties of nanoscal TiAlN/SiNx mulitlayer coating depostited by reactive magnetron sputtering" Surface & Coatings Tech. 203 (2008) p. 171-179.*

Yau et al "Investigation of nanocrystal-(Ti,Al)Nx/amorphous-SiNy composite films by co-depostion" Surface & Coatings Techn. 177-178 (2004) p. 209-214.*

Aguzzoli, et al., "Physicochemical, Structural, and Mechanical Properties of Si3N4 Films Annealed in O2", Journal of Applied Physics, 107:7, pp. 073521-1-073521-9, Apr. 2010.

Translation of the International Preliminary Report on Patentability of PCT/EP2011/063234 dated Feb. 21, 2013.

International Search Report for PCT/EP2011/063234 dated Oct. 3, 2011.

German Search Report for Application No. 10 2010 039 035.6 dated Aug. 6, 2010.

First Office Action (with English Translation) for Chinese Patent Application No. 201180038990.2, dated Jul. 11, 2014.

Zhou Hai "The Research of the Microhardness of Amorphous Silicon Nitride Formed by Direct Current-Plasma Chemical Vapour Deposition" , Materials Science & Engineering, vol. 15, No. 2, pp. 56-60, Jun. 1997 (with English Abstract).

Office Action dated Feb. 3, 2015, for corresponding Japanese patent application No. 2013-522222.

* cited by examiner

*Primary Examiner* — Archene Turner
(74) *Attorney, Agent, or Firm* — Morgan, Lewis & Bockius LLP

(57) ABSTRACT

The invention relates to a cutting tool comprising a main part and a multilayer coating applied thereon. A first layer A made of a hard material is applied on the main part, said hard material being selected from titanium aluminum nitride (TiAlN), titanium aluminum silicon nitride (TiAlSiN), chromium nitride (CrN), aluminum chromium nitride (AlCrN), aluminum chromium silicon nitride (AlCrSiN), and zirconium nitride (ZrN), and a second layer B made of silicon nitride (Si3N4) is applied directly over the first layer A.

20 Claims, No Drawings

CUTTING TOOL WITH MULTI-LAYER COATING

The invention concerns a cutting tool comprising a main body and a multi-layer coating applied thereto.

STATE OF THE ART

Cutting tools include a main body which is made for example from hard metal, cermet, steel or high speed steel and a single-layer or multi-layer hard material coating applied to the main body to increase the service lives or also to improve the cutting properties. CVD processes (chemical vapour deposition) and/or PVD processes (physical vapour deposition) are used to apply the hard material coating.

WO 96/23911 describes a cutting tool comprising a multi-layer wear resistant coating comprising a plurality of individual layers, wherein an individual layer comprising a hard metallic material is applied directly to the main body and further individual layers are arranged thereover so that the individual layers form a periodically repeating composite comprising three different respective individual layers, which each include two different metallic hard material layers and a covalent hard material layer. In an embodiment described as being preferred the three-layer composite comprises two individual layers of titanium nitride and titanium carbide and an individual layer comprising the covalent hard material boron carbide. It is described therein that the wear resistant coating is to include at least three covalent hard material layer portions and thus comprises at least nine individual layers. Preferably the first individual layer disposed on the main body is a layer of titanium nitride or titanium carbide as they are said to adhere well to the main body of steel or hard metal. Besides the particularly preferred boron carbide, silicon carbide, silicon nitride, boron nitride, Sialon (mixed crystal of silicon and aluminium oxynitride), carbon and others are specified for the individual layers of covalent hard material. It has been found however that the described individual layers comprising the hard metallic materials titanium nitride and titanium carbide do not meet the present day demands in terms of protection from wear. Titanium carbide is admittedly hard but it is too brittle for a wear resistant layer. Titanium nitride is softer and less brittle than titanium carbide. Both titanium carbide and also titanium nitride have inadequate temperature resistance for uses involving high temperature loadings. Heat dissipation into the chips and cuttings when machining metal is also inadequate.

Object

The object is attained by a cutting tool comprising a main body and a multi-layer coating applied thereto, wherein applied to the main body is a first layer A of a hard material selected from titanium aluminium nitride (TiAlN), titanium aluminium silicon nitride (TiAlSiN), chromium nitride (CrN), aluminium chromium nitride (AlCrN), aluminium chromium silicon nitride (AlCrSiN) and zirconium nitride (ZrN), and a second layer B of silicon nitride ($Si_3N_4$) is applied directly over the first layer A.

DESCRIPTION OF THE INVENTION

The object is attained by a cutting tool comprising a main body and a multi-layer coating applied thereto, wherein applied to the main body is a first layer A of a hard material selected from titanium aluminium nitride (TiAlN), titanium aluminium silicon nitride (TiAlSiN), chromium nitride (CrN), aluminium chromium nitride (AlCrN), aluminium chromium silicon nitride (AlCrSiN) and zirconium nitride (ZrN), and a second layer B of silicon nitride ($Si_3S_4$) is applied directly over the first layer A.

In comparison with the metallic hard material layers like for example TiC or TiN known from the state of the art, the first nitride layer A has markedly improved temperature resistance and at the same time a high degree of hardness which is comparable to the hardness of TiC but which is not as brittle as same. The second layer of silicon nitride ($Si_3N_4$) is hard and wear-resistant and in combination with the first nitride layer A very effectively prevents heat transfer through the wear resistant coating into the main body and thus promotes improved heat dissipation into the chips and cuttings in metal machining with the cutting tool. Prevention of the heat transfer is similarly effectively caused by the silicon nitride as by aluminium oxide which is very frequently used as a hard wear resistant layer. In addition the second layer B of silicon nitride ($Si_3N_4$) has very high resistance to oxidation even at high temperatures.

In a particularly preferred embodiment of the invention the first layer A of hard material is applied directly to the main body. It affords particularly good adhesion between the silicon nitride and the main body, particularly if the first layer A comprises TiAlN.

In a further preferred embodiment of the invention at least one further periodically repeated succession of layers A and B is applied over the second layer B, wherein the layers A in the periodically repeated succession of layers A and B are also selected from titanium aluminium nitride (TiAlN), titanium aluminium silicon nitride (TiAlSiN), chromium nitride (CrN), aluminium chromium nitride (AlCrN), aluminium chromium silicon nitride (AlCrSiN) and zirconium nitride (ZrN), but can be different from the hard material of the first layer A. Preferably the layers A are each titanium aluminium nitride (TiAlN) and the layers B are respectively silicon nitride ($Si_3N_4$).

In a further preferred embodiment of the invention the silicon nitride ($Si_3N_4$) of the hard material layer B is amorphous. Amorphous silicon nitride has surprisingly good wear resistant properties and good temperature resistance with at the same time a high level of hardness.

The silicon nitride ($Si_3N_4$) of the hard material layer B can respectively contain up to 20 atomic %, preferably up to 5 atomic %, of usual or unusual impurities or doping elements. Those usual or unusual impurities or doping elements are preferably selected from oxygen, carbon, boron, gallium and arsenic.

In a quite particularly preferred embodiment of the invention the hard material of the first layer A is titanium aluminium nitride (TiAlN). TiAlN has proven to be particularly advantageous in combination with the second layer B of silicon nitride ($Si_3N_4$). TiAlN has a cubic face-centered crystal lattice like also TiAlSiN which can be contained in the TiAlN layer in an amount of up to 5% by weight.

In a further embodiment of the invention applied over the layers A and B or the periodically repeated composite of layers A and B is at least one further hard material layer or metallic layer selected from aluminium oxide, aluminium chromium oxide, chromium oxide, zirconium nitride, titanium nitride and aluminium metal, wherein all aforementioned hard materials can be optionally doped with one or more further elements.

In a variant of the invention at least one further hard material layer comprising aluminium oxide is applied over the layers A and B and applied thereover is a further layer of zirconium nitride, titanium nitride or aluminium metal.

The further layers which can be applied over the layers A and B are basically known. Aluminium oxide is for example a very hard and good wear resistant layer, and similarly also aluminium chromium oxide and chromium oxide. In comparison zirconium nitride, titanium nitride and aluminium metal are usually applied for colouring the cutting tool and as indicator layers for use of the cutting tool, in the form of outermost layers.

Desirably the multi-layer coating according to the invention has an overall layer thickness in the region of 2 to 10 μm, preferably 3 to 6 μm. Desirably the first layer A which is preferably applied directly to the main body has a layer thickness in the region of 0.5 to 4 μm, preferably 1 to 3 μm. The layer thicknesses of optionally present further layers A are in comparison desirably in the region of 0.2 to 2 μm, preferably 0.3 to 1 μm. Desirably the layers B have layer thicknesses in the region of 0.2 to 5 μm, preferably 0.3 to 3 μm, particularly preferably in the region of 0.5 to 1 μm. With excessively great layer thicknesses there is generally the risk of spalling because of excessively high mechanical stresses in the layer. With excessively small layer thicknesses there is the danger that the respective individual layer does not perform the function wanted therefrom or does not adequately perform it.

Preferably the layers A and B in the coating according to the invention are layers applied to the main body by means of PVD processes, wherein the layers A are particularly preferably applied by means of arc vapour deposition (arc PVD) and the layers B are particularly preferably applied by means of magnetron sputtering, in particular dual magnetron sputtering or HIPIMS (high power impulse magnetron sputtering).

The main body of the cutting tool according to the invention is preferably produced from hard metal, cermet, steel or high speed steel (HSS).

The novel coating of the present invention affords a broad range of possible options for improving and/or adapting wear resistance, service lives and cutting properties of cutting tools. The wear resistance, stability and cutting properties of a coating on a cutting tool depend on various factors such as for example the material of the main body of the cutting tool, the succession, nature and composition of the layers in the coating, the thickness of the various layers and not least the nature of the cutting operation performed with the cutting tool. Different levels of wear resistance can be afforded for one and the same cutting tool in dependence on the nature of the workpiece to be machined, the respective machining process and the further conditions during the machining operation such as for example the generation of high temperatures or the use of corrosive cooling fluids. In addition a distinction is drawn between various kinds of wear which can influence the period of use of a tool, that is to say its service life, to a greater or lesser extent, depending on the respective machining operation. Therefore further development of and improvement in cutting tools is always to be considered in consideration of which tool properties are to be improved and are to be assessed under comparable conditions in comparison with the state of the art.

Substantial improvements in the cutting tools according to the invention with a main body and a multi-layer coating according to the invention are adhesion of the coating on the main body, which is improved over the state of the art, better high-temperature properties, better hardness values and improved wear resistance.

A further surprising effect which was observed with the coatings according to the invention is a reduction in the thermal conductivity of the overall coating. That surprisingly achieved reduction in thermal conductivity of the coating has a highly positive effect in use of such cutting tools in cutting metals and composite materials. The reduced thermal conductivity leads to improved thermal shock resistance and thus increased comb cracking strength of the material of the main body, in particular hard metal.

It is self-evident that all individual features as are described herein for certain embodiments according to the invention, insofar as this is technically meaningful and possible, can be combined with all other described features of embodiments according to the invention and such combinations are deemed to be disclosed within this description. It is only for reasons of better readability that individual naming of all possible combinations is dispensed with herein.

Further advantages, features and embodiments of the present invention are described by means of the following examples.

EXAMPLES

In a PVD coating installation (Flexicoat; Hauzer Techno Coating) hard metal main bodies were provided with a multi-layer PVD coating. The geometry of the main body was SEHW120408 or ADMT160608-F56 (according to DIN-ISO 1832). Before deposition of the layers the installation was evacuated to $1\times10^{-5}$ mbar and the hard metal surface cleaned by etching with argon ions at 170 V bias voltage.

Example 1

Layer A: TiAlN
PVD-process: Arc vapour deposition (Arc-PVD)
Target: Ti/Al (33/67 atomic %),round source (63 mm diameter)
Deposition: Temperature: 500° C.; vaporiser current: 65 amperes; 3.2 Pa $N_2$ pressure, 50 volts substrate bias voltage
Layer B: $Si_3N_4$
PVD process: Dual magnetron sputtering
Target: Rectangular Si source (80 cm×20 cm)
Deposition: Temperature: 500° C.; 6 W/cm$^2$; 200 sccm $N_2$; 0.5 Pa Ar pressure, 90 volts substrate bias voltage
Structure X-ray amorphous
Bonding character: Covalent according to XPS
Layer succession: Main body/2.5 μm TiAlN/0.6 μm $Si_3N_4$.

Comparative Example 1

Deposition of a 3.3 μm thick TiAlN layer with otherwise the deposition parameters of Example 1, but without deposition of a further silicon nitride layer B.

In a milling test on a workpiece comprising 42CrMo4-steel (strength: 950 MPa), the cutting tools of Example 1 and comparative Example 1 were compared. Downcut milling was effected without cooling lubricant at a cutting speed $v_c$=235 m/min and with a tooth advance $f_2$=0.2 mm. Wear was measured on the relief surface as mean wear mark width VB mm (at the main cutting edge) after a milling travel of 4800 mm.

The following wear mark widths VB were found:

| | Wear mark width VB |
|---|---|
| Example 1: | 0.06 mm |
| Comparative Example 1: | 0.10 mm |

Example 2

The layer of TiAlN and the layer B of $Si_3N_4$ was deposited with the same PVD processes and with the same parameters as in Example 1.

Layer succession: Main body/2.5 μm TiAlN/0.6 μm $Si_3N_4$/0.3 μm TiAlN/0.1 μm $Si_3N_4$/0.3 μm TiAlN/0.1 μm $Si_3N_4$.

Comparative Example 2

Like comparative Example 1, but with deposition of a 4.0 μm thick TiAlN layer.

In a milling test carried out as for Example 1 but with a cutting speed $v_c$=283 m/min and a tooth advance $f_2$=0.3 mm the following wear mark widths VB were found:

| | Wear mark width VB |
|---|---|
| Example 2: | 0.10 mm |
| Comparative Example 2: | 0.30 mm |

The invention claimed is:

1. A cutting tool comprising a main body and a multi-layer coating applied thereto, wherein applied directly to the main body is a first layer A of a hard material selected from titanium aluminium nitride, titanium aluminium silicon nitride, chromium nitride, aluminium chromium nitride, aluminium chromium silicon nitride and zirconium nitride, wherein a second layer B of amorphous silicon nitride ($Si_3N_4$) is applied directly over the first layer A, and wherein the first layer A applied directly to the main body has a layer thickness in the region of 0.5 to 4 μm and the second layer B has a layer thicknesses in the region of 0.2 to 5 μm.

2. A cutting tool according to claim 1, wherein at least one further periodically repeated succession of layers A and B is applied over the second layer B, wherein the layers A in the periodically repeated succession of layers A and B are also selected from titanium aluminium nitride, titanium aluminium silicon nitride, chromium nitride, aluminium chromium nitride, aluminium chromium silicon nitride and zirconium nitride, and have a layer thicknesses in the region of 0.2 to 2 μm, and wherein the layers B in the periodically repeated succession of layers A and B have a layer thicknesses in the region of 0.2 to 5 μm.

3. A cutting tool according to claim 2, wherein further layers A, other than the first layer A applied directly to the main body, have layer thicknesses in the region of 0.3 to 1 μm.

4. A cutting tool according to claim 2, wherein layers A in the periodically repeated succession of layers A and B are a different material from the hard material of the first layer A.

5. A cutting tool according to claim 1, wherein the silicon nitride of the hard material layer B respectively contains up to 20 atomic %, of usual or unusual impurities or doping elements.

6. A cutting tool according to claim 5, wherein the silicon nitride of the hard material layer B respectively contains up to 5 atomic % of usual or unusual impurities or doping elements.

7. A cutting tool according to claim 6, wherein the usual or unusual impurities or doping elements are selected from oxygen, carbon, boron, gallium and arsenic.

8. A cutting tool according to claim 1, wherein the hard material of the first layer A is titanium aluminium nitride.

9. A cutting tool according to claim 1, wherein at least one further hard material layer comprising aluminium oxide is applied over the layers A and B and applied thereover is a further layer of zirconium nitride, titanium nitride or aluminium metal.

10. A cutting tool according to claim 1, wherein the multi-layer coating has an overall layer thickness in the region of 2 to 10 μm.

11. A cutting tool according to claim 10, wherein the multi-layer coating has an overall layer thickness in the region of 3 to 6 μm.

12. A cutting tool according to claim 1, wherein the layers A and B are layers applied to the main body by means of PVD processes.

13. A cutting tool according to claim 12, wherein the layers A are applied by means of arc vapour deposition (arc PVD) and the layers B are applied by means of magnetron sputtering.

14. A cutting tool according to claim 13, wherein the layers B are applied by means of dual magnetron sputtering or HIPIMS.

15. A cutting tool according to claim 1, wherein the main body is produced from hard metal, cermet or steel.

16. A cutting tool according to claim 1, wherein the first layer A applied directly to the main body has a layer thickness in the region of 1 to 3 μm.

17. A cutting tool according to claim 1, wherein the layers B have layer thicknesses in the region of 0.3 to 3 μm.

18. A cutting tool according to claim 17, wherein the layers B have layer thicknesses in the region of 0.5 to 1 μm.

19. A cutting tool according to claim 1, wherein over the layers A and B there is applied at least one further hard material layer. selected from aluminium oxide, aluminium chromium oxide, chromium oxide, zirconium nitride and titanium nitride or there is applied at least one further metallic layer of aluminium metal.

20. A cutting tool according to claim 1, wherein the main body is produced from high speed steel.

* * * * *